US006260686B1

(12) United States Patent
Rigo

(10) Patent No.: US 6,260,686 B1
(45) Date of Patent: Jul. 17, 2001

(54) DEVICE FOR IDENTIFICATION OF COINS AND/OR TRANSPONDERS

(75) Inventor: Fabrizio Rigo, Bologna (IT)

(73) Assignee: O.T.R. S.R.L., Bologna (IT)

( * ) Notice: Subject to any disclaimer, the term of this patent is extended or adjusted under 35 U.S.C. 154(b) by 0 days.

(21) Appl. No.: 09/332,495

(22) Filed: Jun. 14, 1999

(30) Foreign Application Priority Data

Jun. 19, 1998 (IT) ..... B098A0382

(51) Int. Cl.[7] ..... G07F 7/02; G07F 7/10
(52) U.S. Cl. ..... 194/210; 194/213
(58) Field of Search ..... 194/210, 213, 194/317, 318, 351

(56) References Cited

U.S. PATENT DOCUMENTS 4,006,342 * 2/1977 Baumann et al. ..... 194/210 X
4,185,730 * 1/1980 Roes et al. ..... 194/210
4,674,618 * 6/1987 Eglise et al. ..... 194/210
4,926,996 * 5/1990 Eglise et al. ..... 194/205 X
4,969,549 * 11/1990 Eglise ..... 194/213 X
5,697,482 * 12/1997 Orus et al. ..... 194/213

FOREIGN PATENT DOCUMENTS

2206720 * 5/1977 (GB) ..... 194/211
2551893 A1 * 5/1977 (DE) ..... 194/210
2197975 * 6/1988 (GB) ..... 194/213
WO 87/06042 A1 * 10/1987 (WO) ..... 194/210

* cited by examiner

*Primary Examiner*—Christopher P. Ellis
*Assistant Examiner*—Thuy V. Tran
(74) *Attorney, Agent, or Firm*—William J. Sapone; Coleman Sudol Sapone, P.C.

(57) ABSTRACT

In a device for identification of predetermined coins and/or transponders, coils are connected to a control unit for detecting the passage of predetermined coins and for identifying a code of circular transponders. A stop is operated for stopping the transponders, under control of the control unit, after identification of the transponder code, while the coils read/writes the credit value remaining in the transponder.

16 Claims, 5 Drawing Sheets

DEVICE FOR IDENTIFICATION OF COINS AND/OR TRANSPONDERS

FIELD OF THE INVENTION

The present invention relates to electronic devices for identification and storing of credit values, to be used in stations and/or machines for automatic distribution of goods and/or services, video games, etc., with particular reference to devices for identification of predetermined coins or transponders.

DESCRIPTION OF THE PRIOR ART

Different types of stations and/or machines for automatic distribution of goods and/or services have heretofore been provided, as featuring a suitable device for identification of coins or for storing a credit value.

A device of this type, e.g. an electronic slot machine, identifies, according to known techniques, the kind of coin introduced therein by the user; if the coin corresponds to one of the models for which the slot machine is used, it is collected, otherwise it is given back to the user.

When the value of the introduced and collected coins reaches the value of a corresponding good and/or service, the electronic slot machine operates the distributor to deliver the article.

It is obvious that the user must have a big number of coins, in relation to the importance of the required service or to the quantity and value of the required goods.

Obviously, this necessity is very inconvenient for the user, who must always be sure to have a big number of coins, which are not always easy to find and which are also heavy and cumbersome.

The electronic slot machines of the stations and/or machines for automatic distribution of goods and/or services can be substituted or integrated by another device which is situated on the machine outer surface for introduction and identification of only electronic means for storing credit values.

The encoded electronic means for credit values storing, e.g. a transponder, are distinguished by an identification code and can be charged up to the credit value desired by the user, upon paying a suitable sum of money.

In this case, after the identification, a suitable device interacts with the transponder, so as to make a credit transition and operate the distributor to deliver the desired article.

However, the application of an additional device for identification of transponders changes the aesthetic look of the outer surface of the stations and/or machines for automatic distribution of goods and/or services, video games stations, etc.

Moreover, the possibility to set up an area on the outer surface of the distributors and beside the slot machines for application of the transponder identification device, must be taken into consideration during the machine design.

SUMMARY OF THE INVENTION

This invention was evolved with the general object of providing a device suited to introduction and identification of either predetermined coins or the electronic means of credit value storing.

Another object of the present invention is to propose a device which can be used with the already existing slot machines for identification of coins only by adapting them for the introduction and identification, as well as interaction with transponders.

A further object of the present invention is to propose a device for identification of coins and/or transponders which does not change in any way the aesthetic look of the distributors of goods and/or services, video games stations, etc.

Still another object of the present invention is to propose a device which prevents a user, previously provided with a suitably transponder, from useless waste of time for looking for big number of coins.

Yet further object of the present invention is to propose a device for identification and subsequent encoded storing of credit, which is easy to use for anyone and rapid, reducing the time necessary for obtaining required goods and/or services.

Still a further object of the present invention is to propose a device which not only identifies and interacts with transponders, but also charges them in a rapid and simple way.

The proposed device is obtained by a simple, extremely reliable technical solution, which is also functional and cheap.

The above mentioned objects are obtained, in accordance with the contents of the claims, by means of a device for identification of predetermined coins and/or transponders, the device including:

- a case featuring, on its outer surface, a first rectangular slot for introduction of coins and a second rectangular slot for ejection of coins;
- a sliding channel and a discharge channel, which are situated in series inside said case and extends downwards from said first slot to said second slot; a control unit;
- first detecting means formed by coils and situated on a lateral walls of said sliding channel under the first slot for detecting the passage of predetermined coins, said first detecting means being connected to said control unit;
- a baffle, also connected to said control unit, operating in a way to join said sliding channel either with a connecting channel for coins collection or with said discharge channel for coins returning;
- said device also including:
- second detecting means, connected to said control unit for identifying a code of circular transponders introduced into said first slot and passing through said sliding channel;
- means for stopping said transponders, controlled by the control unit, after identification of the transponder code;
- means for reading/writing a credit value remaining in the transponder, this reading/writing means being connected to said control unit for operation of said baffle, so as to join said sliding channel with said discharge channel for returning said transponders, or to join said sliding channel with said connecting channel for collecting transponders out of credit.

In accordance to a second embodiment, the stopping means are not mounted and reading/writing operation are performed when the transponder passes close to the reading/writing means.

BRIEF DESCRIPTION OF THE DRAWINGS

This invention contemplates other objects, features and advantages which will become fully apparent from the following detailed description of some preferred, but not exclusive embodiments taken in conjunction with the accompanying drawings, in which.

DESCRIPTION OF THE PREFERRED EMBODIMENT

Figure 2:
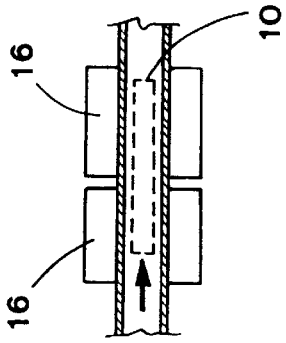
FIG. 2 is a schematic sectional view taken along line II—II of FIG. 1.

With reference to the above mentioned figures, reference numeral 1 generally designates a box-like case, numeral 11 indicates a first rectangular slot for introduction of the predetermined coins or circular transponders 10, and numeral 13 indicates a second slot, featuring a stop 14 for a possible rejection of the coin or returning of the transponder.

The first rectangular slot 11, situated in the upper part of the case 1, on its front surface, accessible from outside, forms a mouth of a sliding channel 15. The shape of the channel is such that different types of coins or transponders can be freely received therein.

The sliding channel 15 extends inside the case 1, from its top downwards, so as to guide the coin or transponder along a well defined path on different levels.

Detecting and identification means, formed by e.g. as in FIG. 1, a couple of coils 16, are situated in the sliding channel 15 on its lateral walls and on a first level below the slot 11.

It is to be noted that the detecting and identification means can be also formed by a single coil of any shape, with or without inner core, and adapted to work within any frequency range.

The coils 16 for identifying predetermined coins and transponders are connected to a control unit 17.

The coils 16 act as a primary winding and a secondary winding of a transformer and detect possible changes of the medium situated therebetween.

If a coin is introduced into the slot, the coils detect and identify the characteristic features of any type of coin, such as material, mass, geometry, etc.), and if a transponder is introduced into the slot, the coils identify its code.

Each type of coins and each transponder code is associated with a signal or impulse which will be sent to the control unit 17.

The control unit 17 is interfaced, by known interface means, with a first actuator 18 situated on the final level of the sliding channel 15, and with a second actuator 181, situated on a lower level, near the mouth of a connecting channel 153.

The first actuator 18 controls a positioning member 19 situated in the falling area of the sliding channel 15, so as to stop the transponder descent blocking it near an electronic data reading/writing sensor 171.

The electronic data reading sensor 171, suitably interfaced with the control unit 17 by known connecting means, reads the amount of credit still stored in the transponder.

The second actuator 181 controls the baffle 191, so as to make it assume two different positions.

Figure 3:
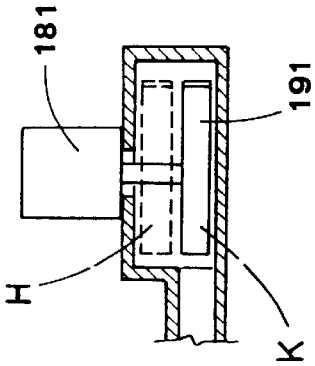
FIG. 3 is a schematic sectional view taken along line III—III of FIG. 1.

When in its first position, e.g. indicated with H in FIG. 3, the baffle 191 joins the terminal part of the sliding channel 15 to the mouth of the connecting channel 153; when in its second position, indicated with K in FIG. 3, the baffle 191 joins the sliding channel 15 to a discharge channel 151, at the end of which there is the second slot 13.

The joining of the sliding channel 15 to the connecting channel 153 allows to collect coins which have been identified as valid, while joining of the sliding channel 15 to the discharge channel 151 allows to reject the unidentified coins or transponders.

The joining of the sliding channel 15 and the connecting channel 153 can also allow to collect the transponders out of credit, according to the administrator of the stations and/or automatic machines for distribution of goods and services.

This can be particularly useful in amusements arcades, where it is convenient for the store-owner to get back the transponders out of credit to re-charge them and sell again to the users.

It is to be noted that in non working conditions, the baffle 191 can assume either the first position H or the second position K.

The control unit 17, suitably programmed, enables the baffle 191, by the actuator 181, to assume the desired position, either for coins/transponder collection or for rejection of unidentified coins or for transponders returning, according to the information received either from the electronic data reading sensor 171 in case of transponder, or from the coils 16 in case of coins.

Operation of the proposed device will be described in the following beginning from introduction of a coin or a circular transponder.

In first case, the coin is introduced in the first slot 11 and let fall in the sliding channel 15.

The coin follows the path defined by the sliding channel 15 and passes between the coils 16 which detect possible changes of the medium situated therebetween.

Then the coils send to the control unit 17 a signal corresponding to the detected type of coin.

If the control unit 17 identifies the type of signal as known and corresponding to a predetermined type of coin, it enables the second actuator 181 to operate the baffle 191 to assume the position in which it joins the sliding channel 15 to connecting channel 153.

This way, the coin can arrive to the credit storing device and increase the collected credit to reach the value of the desired good and/or service.

Otherwise, if the control unit 17 does not identify the received signal as known, it enables the second actuator 181 to operate the baffle 191 to assume the position in which it joins the sliding channel 15 to the discharge channel 151, so as to reject the coin which appears on the stop 14 of the second slot 13.

In the other case, the transponder of circular form is introduced in the first slot 11 and let fall in the sliding channel 15.

The transponder follows the path defined by the sliding channel 15 and passes between the coils 16 which detect its identifying code.

Then the coils 16 send a signal to the control unit 17 that a transponder with credit stored therein has been introduced.

The control unit 17 enables the first actuator 18 to operate the positioning member 19, so as to stop the transponder descent near the electronic data reading sensor 171.

The electronic data reading sensor 171 detects if the credit of the transponder is enough to deliver the desired good and/or service.

In affirmative case, the electronic data reading/writing sensor 171 detracts the sum relative to the required good and/or service from the stored credit value.

Moreover, the electronic data reading sensor 171 sends a signal to the first actuator 18 to make the positioning member 19 return, so that the transponder can continue its run.

Simultaneously, the electronic data reading sensor 171 sends a signal to the control unit 17 to operate, by the second actuator 181, the baffle 191, so as to make it assume the position in which it joins the sliding channel 15 and the discharge channel 151.

This way, the transponder with the stored credit value remained, is returned to the user through the second slot 13.

In negative case, the electronic data reading sensor 171 can detect that the transponder is out of credit or that the stored credit value is lower than the requested value.

In this case, the electronic data reading sensor 171 sends a signal to the control unit 17 to operate the second actuator 181, so as to join the sliding channel 15 and the discharge channel 151, in the above described way, so as to return the transponder to the user and possibly communicate him/her, by a suitable display, that the credit stored therein is not big enough or off.

The same operations are carried out also in case the sum relative to the value of requested good and/or service is equal to the transponder credit.

If requested by the administrator of stations and/or automatic machines for distribution of goods and/or services, it is also possible to program the control unit 17 so that the baffle 191 joins the sliding channel 15 to the connecting channel 153 so as to collect the transponders out of credit.

In this case, the administrator will store new credit values in the transponder, whereas if the transponder is returned to the user, the user himself will store the new credit value therein.

According to a possible embodiment, the proposed device, in addition to the coils 16 or instead of them, is equipped with a sensor for identifying transponders with credit values stored therein, interfaced with the control unit 17 by known means.

Figure 1:
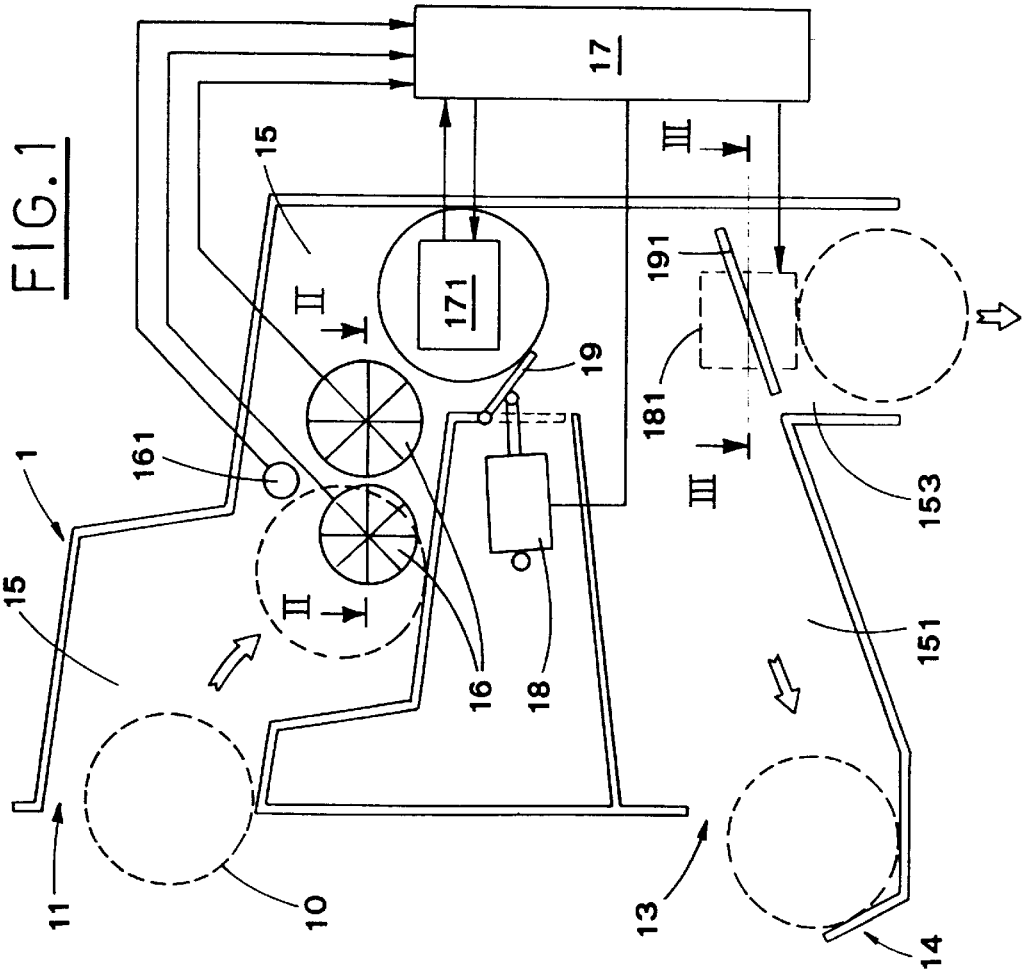
FIG. 1 is a schematic, front sectional view of the proposed device in some working steps particularly important for the identification of the predetermined coins and/or transponders.
Figure 5:
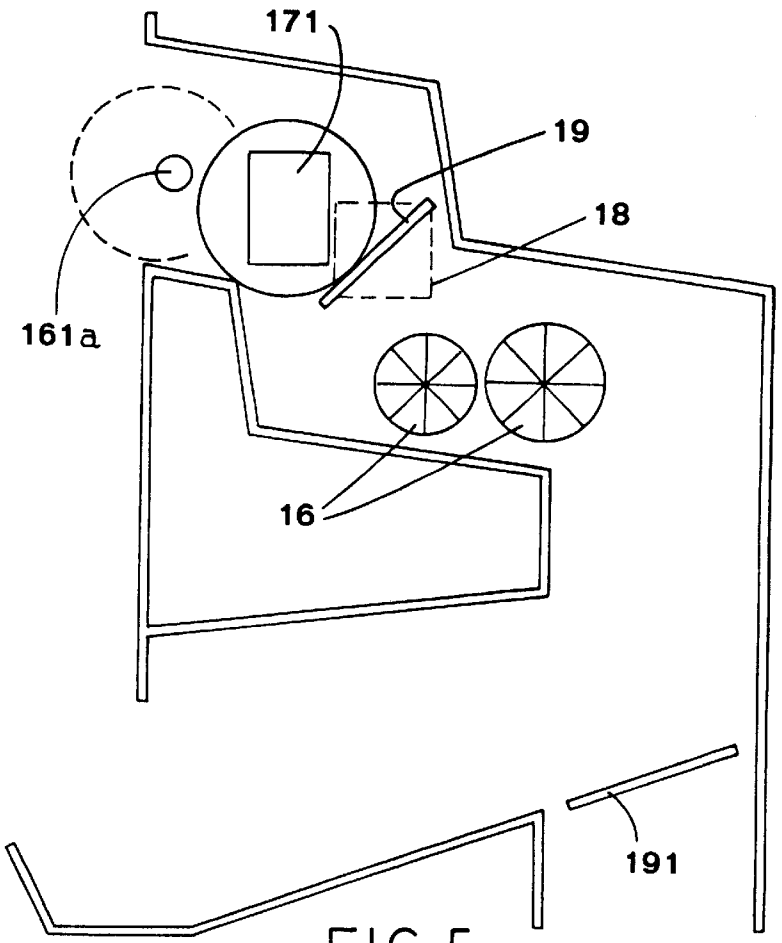
FIGS. 5, 6 and 7 are schematic, front sectional views of other embodiments of the proposed device.
Figure 4:
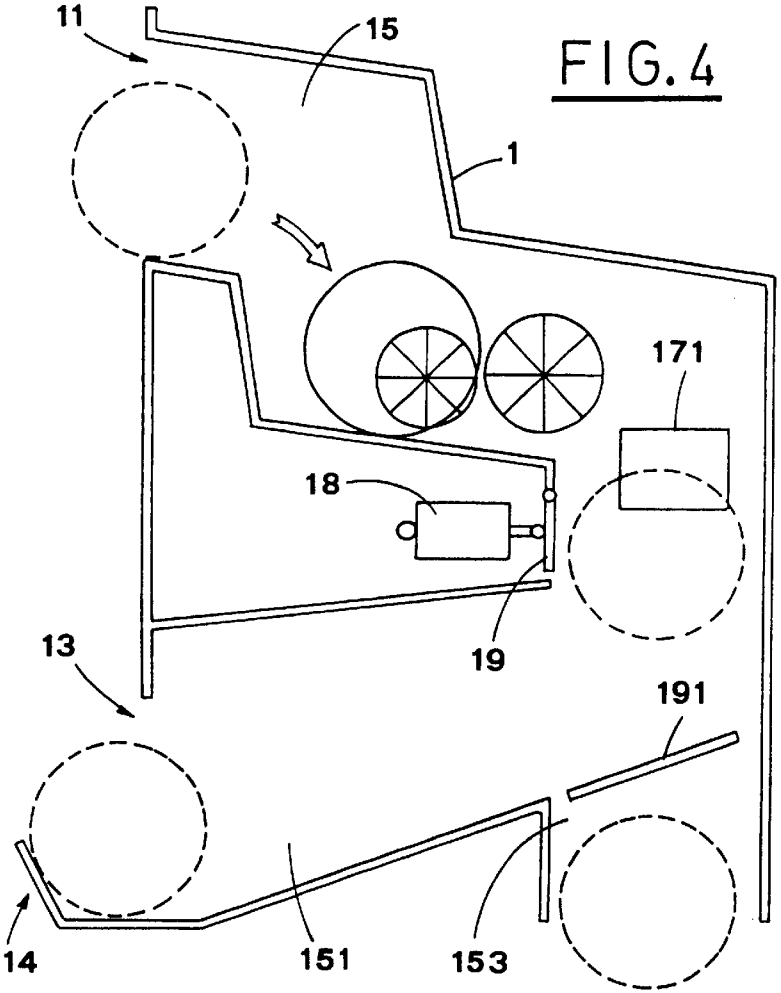
FIG. 4 is a schematic, front sectional view of the proposed device in some working steps of identification of a coin.
Figure 7:
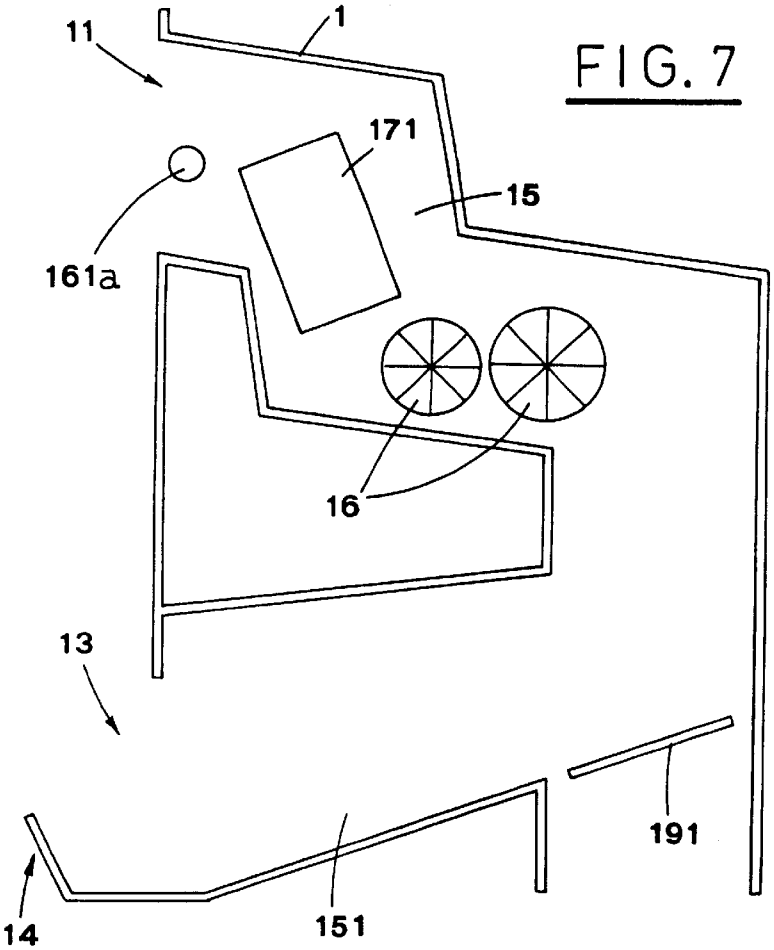

The additional (or substitute) sensor, indicated with 161 in FIG. 1, can be situated in place of the coils 16 or, as indicated with 161*a* in FIGS. 5, 7, immediately after the mouth of the sliding channel 15.

According to another embodiment of the present invention, shown in FIG. 5, the electronic data reading/writing sensor 171 and the first actuator 18 with the positioning member 19 are situated immediately after the mouth of the sliding channel 15 and downstream of the sensor 161.

Figure 6:
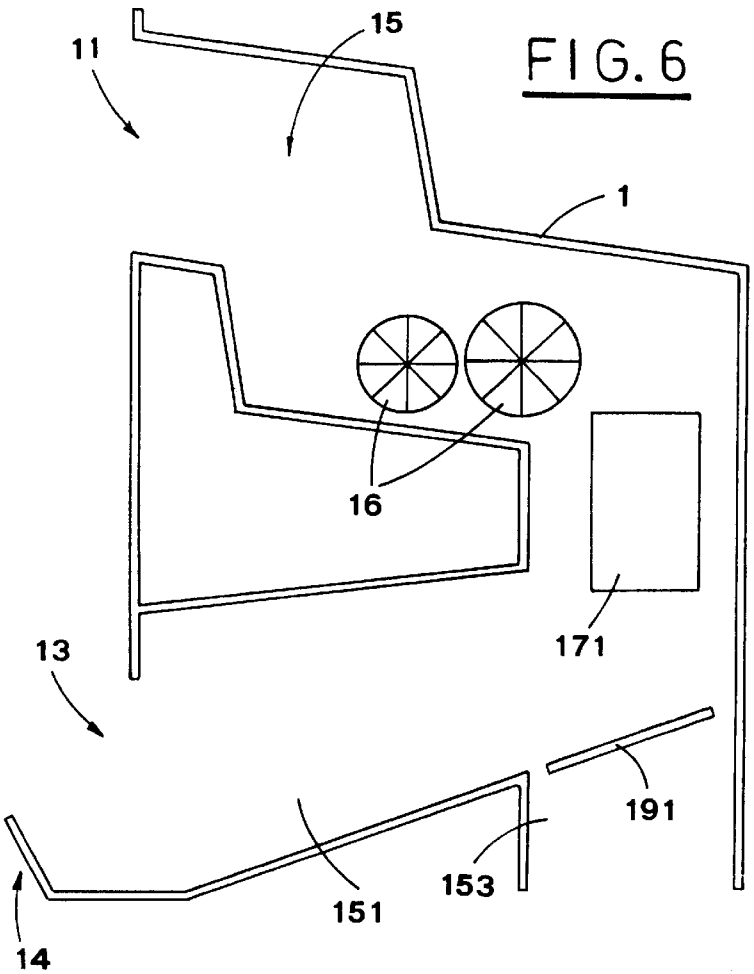

According to two other embodiments, shown in FIGS. 6, 7, the device features either the coils 16 or the sensor 161 for identification of transponders and it does not feature the first actuator 18 and the positioning member 19.

Thus, the electronic data reading/writing sensor 17 reads the transponder rapidly, advantageously accelerating the reading operation of the remaining credit and consequently, allowing to optimize the credit accumulation and distribution of the good and/or service.

In these cases, the electronic data reading/writing sensor 171 can be situated either at the end of the sliding channel 15 or downstream of the sensor 161*a* placed immediately after the mouth of the sliding channel 15.

According to another interesting embodiment, not shown, the location of the electronic data reading/writing sensor 171 can coincide with the location of the coils 16, and the electronic data reading/writing sensor 171 can read the transponder rapidly (without the positioning member 19) or the transponder, stopped by the positioning member 19, can be read in the previously described ways.

Figure 8:
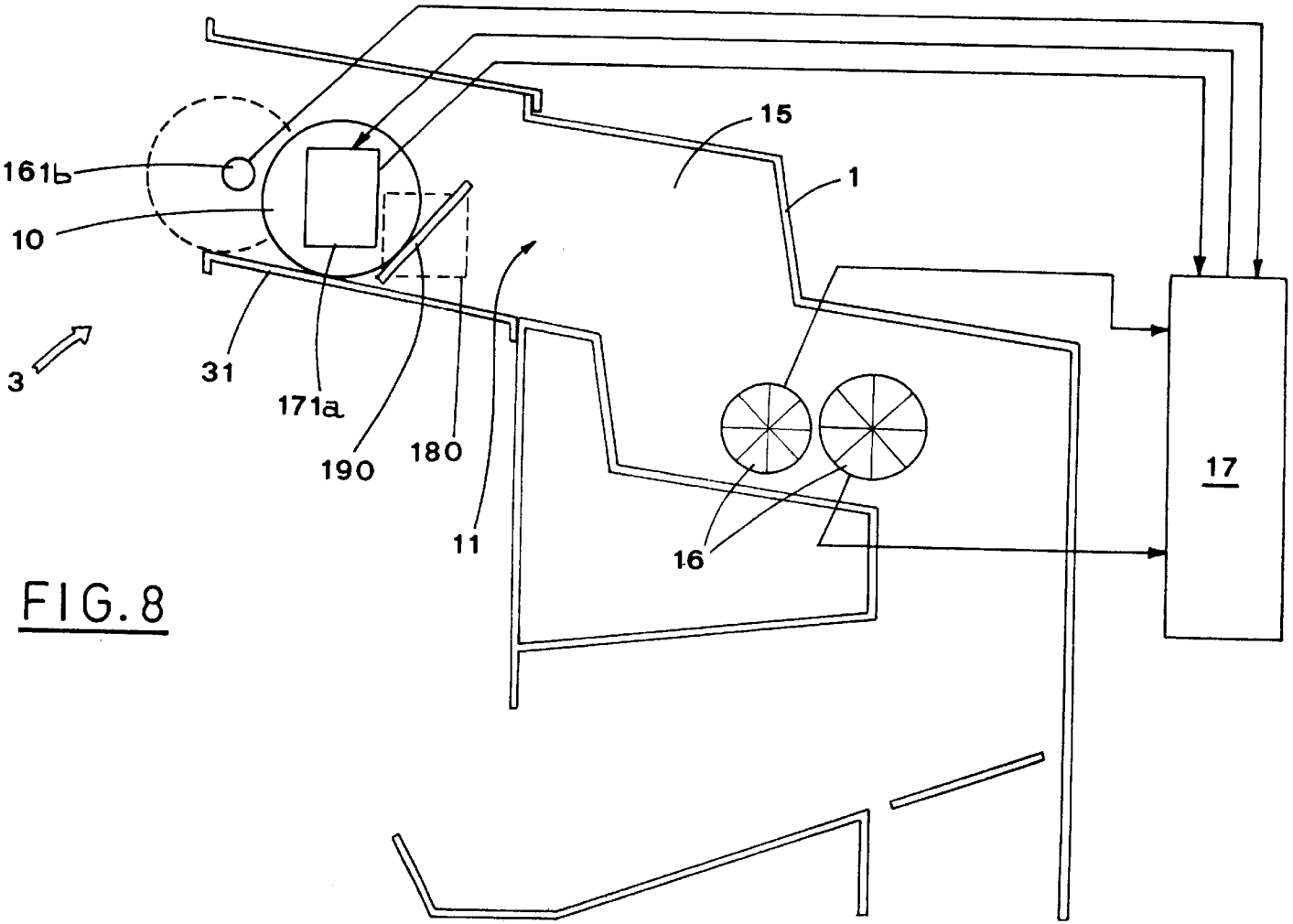
FIG. 8 is a schematic, front sectional view of another intersecting embodiment of the proposed device, connected to an already existing slot machine.

FIG. 8 shows a further and particularly interesting embodiment of the proposed device.

In this case, the reference numeral 1 indicates the case of a normal and common slot machine identifying only coins and including the sliding channel 15, the coils 16, the control unit 17, the discharge channel 151, the connecting channel 153 and the baffle 191.

This slot machine is adapted to identification of transponders by adding an outer unit 3, including an inlet channel 31 which joins with the mouth of the sliding channel 15 in the area of the slot 11.

Inside the channel 15 there are situated a sensor 161*b*, an electronic data reading/writing sensor 171*a*, and actuator 180 and a positioning member 190.

The sensor 161*b*, suitably interfaced with the control unit 17 by known means, send a signal to the control unit that a transponder 10 has been introduced and reads its identification code.

The control unit 17 enables the actuator 180 to operate the positioning member 190 in such a way, as to intercept the transponder and place it in the area of the electronic data reading/writing sensor 171*a*.

The electronic data reading/writing sensor 171*a*, interfaced with the control unit 17 by known means, detects possible credit still stored in the transponder 10 and detects therefrom the sum corresponding to the value of the requested good or service.

After having detracted this sum, the electronic data reading/writing sensor 171*a* send a signal to the control unit 17 to enable the actuator 180 to withdraw the positioning member 190.

This way, the transponder leaves the inlet channel 31, slides in the sliding channel 15, passes through the connecting channel 153 and is ejected by the slot 13.

Also in this particular embodiment it is possible to position the baffle 191, so as to join the sliding channel 15 with the connecting channel 153 for collecting transponders out of credit.

If coins are introduced into the slot machine, the sensor 161*b* detects that no transponder has been introduced and send a signal to the control unit not to operate the positioning member 190.

Therefore, the coins go beyond the outer unit 3 and enter the sliding channel 15 of the slot machine.

Figure 9:
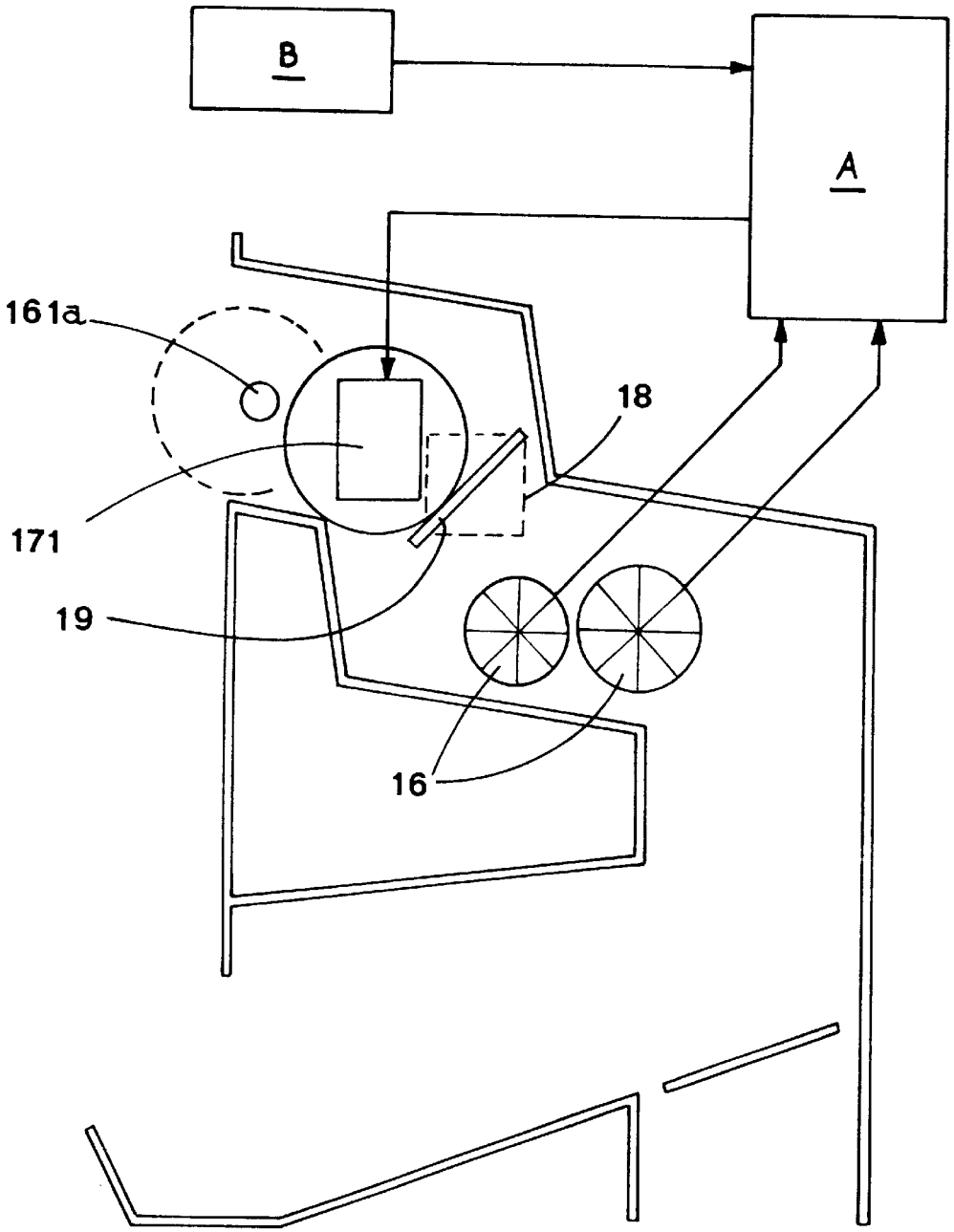
FIG. 9 is an extremely schematic view of the significant elements connected to the device for storing credit values in the transponders.

According to all described embodiments, the proposed device for identification of predetermined coins and/or transponders can be also equipped, as shown in FIG. 9, with a credit storing and updating electronic element A, so as to allow the user to personally store new credit values in the transponder out of credit.

The credit storing and updating electronic element A is interfaced, by known means, with the electronic data reading sensor 171 and the coils 16.

If the transponder is out of credit, it is enough to introduce such a number of coins, as to reach the desired value of re-charge; the coils 16 detect the values of single coins and signal it to the electronic element A which stores the credit.

After having reached the desired value, the user introduces the transponder which is stopped by the positioning member in the area of the electronic data reading/writing sensor and the electronic element A updates the transponder credit by the electronic data reading/writing sensor 171.

The transponder credit can be also read rapidly and in this case there is no positioning member.

Moreover, a banknote reader B can be connected to the credit storing and updating electronic element A for accumulating credit necessary to store new credit value in the transponder.

One of the advantages of the present invention is that it proposes a device, obtained by all described embodiments, which is able to receive and identify predetermined coins as well as credit storing encoded electronic means, like e.g. circular transponders.

This allows the user, previously equipped with the suitable transponder, to avoid useless wastes of time to look for a big number of coins.

Moreover, it is to be pointed out that the proposed device can be easily integrated with already used slot machines, adapting these machines to identification of transponders without changing the look of the outer surface of the distributing machines.

Another advantage of the present invention is that it proposes a device, which is easy to use for anyone and rapid, reducing the time necessary for obtaining required goods and/or services.

It is also to be pointed out that the elements of the proposed device are simple to manufacture and few, which reduces production costs.

The above mentioned advantages are obtained by a simple, extremely reliable technical solution, which is also functional and cheap.

It is understood that what above has been described as a mere, non limitative example, therefore possible constructive variants of the proposed device remain within the protective scope of the present technical solution, ad described above and claimed in the following.

What is claimed is:

1. A device for identification of predetermined coins and/or transponders comprising:

a case having, on an outer surface thereof, a first rectangular slot for introduction of coins and a second rectangular slot for ejection of coins;

a sliding channel and a discharge channel, the sliding channel and the discharge channel located in series inside said case and extending downwards from said first slot to said second slot;

a control unit;

first detecting means formed by coils for detecting the passage of predetermined coins, said first detecting means being connected for said control unit;

a baffle, connected to said control unit, operable to join said sliding channel either with a connecting channel for coin collection or with said discharge channel for coin return;

second detecting means, connected to said control unit for identifying a code of circular transponders introduced into said first slot and passing through said sliding channel;

means for stopping said transponders, controlled by the control unit, after identification of the transponder code;

means for reading/writing a credit value remaining in the transponder, said reading/writing means being connected to said control unit which operates said baffle, so as to join said sliding channel with said discharge channel for returning said transponders, or to join said sliding channel with said connecting channel for collecting transponders out of credit;

said second detecting means having a sensor located in an area of the upper mouth of the sliding channel, the stopping means and the reading means situated downstream of said sensor.

2. The device according to claim 1, wherein said second detecting means include said first detecting means.

3. The device according to claim 1, wherein said stopping means include an actuator, located on a final level of said sliding channel for operating a positioning member.

4. The device according to claim 1 wherein said reading/writing means has an electronic data reading sensor located near said stopping means.

5. The device according to claim 1, wherein said reading/writing means include said first detecting means.

6. The device according to claim 1, wherein said second detecting means include a sensor located near said first detecting means.

7. The device according to claim 1, wherein said second detecting means, said stopping means, said reading/writing means, all connected to the control unit, are included in an additional unit located outside of said case, said additional unit including an inlet channel connectable to the upper mouth of said sliding channel in the area of the first slot.

8. The device according to claim 7, wherein said second detecting means include a sensor connected to said control unit, and said stopping means include an actuator situated downstream of said sensor, said control unit responsive to said sensor for operating a positioning member, said reading/writing means including an electronic data reading sensor located in an area of said positioning member.

9. The device according to claim 1, further comprising a credit value storing and updating electronic element interfaced with said first detecting means, for storing credit values corresponding to the value of coins being introduced, said reading/writing means updating and re-charging said transponders.

10. A device for identification of predetermined coins and/or transponders comprising:

a case having, on an outer surface thereof, a first rectangular slot for introduction of coins and a second rectangular slot for ejection of coins, a sliding channel and a discharge channel, located in series inside said case and extending downwards from said first slot to said second slot;

a control unit;

first means formed by coils for detecting the passage of predetermined coins, said first means being connected to said control unit;

a baffle connected to said control unit and operated thereby to join said sliding channel either with a connecting channel for coin collection or with said discharge channel for coin return;

second means, connected to said control unit for identifying a code of circular transponders introduced into said first slot and passing through said sliding channel;

means for reading/writing data stored in said transponders, said reading/writing means being connected to said control unit which operates said baffle, so as to join said sliding channel with said discharge channel for returning said transponders, or to join said sliding channel with said connecting channel for collecting transponders out of credit;

said second means having a sensor located in an area of the upper mouth of the sliding channel, the reading/writing means situated downstream of said sensor.

11. The device according to claim 10, wherein said second means include said first means.

12. The device according to claim 10, wherein said reading/writing means include an electronic data reading sensor located on a final level of said sliding channel.

13. The device according to claim 10, wherein said reading/writing means include said first means.

14. The device according to claim 10, wherein said second means include a sensor located in an area of said first means.

15. The device according to claim 10, further comprising a credit value storing and updating electronic element interfaced with said first means, for storing credit values corresponding to the value of coins being introduced, said reading/writing means updating and re-charging said transponders for said credit values.

16. The device according to claim 15, wherein a banknote reader is connected to said electronic element.

* * * * *